US006713953B1

(12) United States Patent
Sung et al.

(10) Patent No.: US 6,713,953 B1
(45) Date of Patent: Mar. 30, 2004

(54) FIELD EMISSION DISPLAY DEVICE WITH MINIMAL COLOR CROSS-TALK BETWEEN TWO ADJACENT PHOSPHOR ELEMENTS

(75) Inventors: Un Cheol Sung, Seoul (KR); Ick Hwan Ko, Seoul (KR); Kyo Woong Lee, Kyoungki-do (KR); Young Wook Ko, Seoul (KR)

(73) Assignee: Boe-Hydis Technology Co., Ltd., Kyoungki-do (KR)

( * ) Notice: Subject to any disclaimer, the term of this patent is extended or adjusted under 35 U.S.C. 154(b) by 244 days.

(21) Appl. No.: 09/597,020

(22) Filed: Jun. 20, 2000

(30) Foreign Application Priority Data

Jun. 21, 1999 (KR) ..... 99-23174

(51) Int. Cl.[7] ..... H01J 63/04

(52) U.S. Cl. ..... 313/495; 313/496; 313/466; 313/473; 313/474; 313/479; 313/497; 313/485; 445/24; 445/25

(58) Field of Search ..... 313/495, 496, 313/497, 466, 461, 473, 474, 479, 485; 445/24, 25

(56) References Cited

U.S. PATENT DOCUMENTS

| | | | | | |
|---|---|---|---|---|---|
| 4,325,002 | A | * | 4/1982 | Kobale et al. | 313/485 |
| 4,352,042 | A | * | 9/1982 | Lorenz et al. | 313/485 |
| 5,576,596 | A | * | 11/1996 | Curtin et al. | 313/268 |
| 5,577,943 | A | | 11/1996 | Vickers et al. | 445/24 |
| 5,608,285 | A | | 3/1997 | Vickers et al. | 313/466 |
| 5,619,097 | A | | 4/1997 | Jones | 313/495 |
| 5,670,296 | A | | 9/1997 | Tsai | 430/312 |
| 5,717,288 | A | * | 2/1998 | Huang | 313/466 |
| 5,725,407 | A | * | 3/1998 | Liu et al. | 427/68 |
| 5,786,663 | A | * | 7/1998 | Meyer et al. | 313/466 |
| 5,814,934 | A | | 9/1998 | Tsai | 313/495 |
| 6,046,539 | A | * | 4/2000 | Haven et al. | 313/461 |
| 6,225,737 | B1 | * | 5/2001 | Pong et al. | 313/309 |
| 6,319,381 | B1 | * | 11/2001 | Nemelka | 204/485 |
| 6,383,696 | B2 | * | 5/2002 | Nemelka | 430/24 |

FOREIGN PATENT DOCUMENTS

| | | | | |
|---|---|---|---|---|
| JP | 63119140 | | 5/1988 | |
| JP | 63287821 | | 11/1988 | |
| JP | 09134686 | A * | 5/1997 | H01J/29/28 |
| JP | 09323472 | | 12/1997 | |
| JP | 10040815 | | 2/1998 | |
| JP | 01104815 | | 1/1999 | |

* cited by examiner

*Primary Examiner*—Ashok Patel
*Assistant Examiner*—Sikha Roy
(74) *Attorney, Agent, or Firm*—Ladas & Parry

(57) ABSTRACT

Disclosed is a field emission display device which can prevent mixing of colors between the phosphor elements of the field emission display device. In the field emission display device, an upper substrate and a lower substrate are spaced apart with a predetermined gap and opposed to each other. Cathode assemblies are formed in a shape of stripes on the lower substrate. Anodes are formed on the upper substrate, and black matrices are formed on the anodes. The black matrices are disposed at locations respectively corresponding to every space between the cathode assemblies, so as to respectively have a shape of a partition. R, G, and B phosphor elements are formed in spaces between the black matrices, so as to respectively correspond to the cathode assemblies.

12 Claims, 6 Drawing Sheets

FIELD EMISSION DISPLAY DEVICE WITH MINIMAL COLOR CROSS-TALK BETWEEN TWO ADJACENT PHOSPHOR ELEMENTS

BACKGROUND OF THE INVENTION

1. Field of the Invention

The present invention relates to a field emission display device which can prevent mixing of colors between the phosphor elements of the field emission display device.

2. Description of the Related Art

In general, field emission display devices are used in display panels of electron guns, microwave tubes, ion sources, scanning tunneling microscopes, etc.

In the conventional field emission display device as such, a plurality of cathodes 2 are formed on a lower substrate 1 in a shape of stripes, as shown in FIG. 1. Above each of the cathodes 2 is disposed a gate electrode 3 through which portions of each cathode 2 are exposed. Metal tips 4 are formed on the exposed portions of the cathode 2.

A plurality of anodes 11 are formed in a shape of stripes on an inner surface of an upper substrate 10 which is opposed to the lower substrate 1. The anodes 11 extend making angles with the extending direction of the cathodes 2, for example, the anodes 11 extend in the transverse direction of the cathodes 2 as shown. On the anodes 11 are disposed red, green, and blue (hereinafter, R, G, and B) phosphor elements 12*a*, 12*b*, and 12*c* corresponding to the cathodes 2. Further, black matrices 13 are formed at both sides of the R, G, and B phosphor elements 12*a*, 12*b*, and 12*c* to define the borders between the phosphor elements. In this case, the height of the R, G, and B phosphor elements 12*a*, 12*b*, and 12*c* and the black matrices 13 is about several micrometers. Moreover, a spacer 14 is interposed between the lower substrate 1 and the upper substrate 10, so as to maintain the gap between them.

In the conventional field emission display device having the above mentioned construction, electrons accelerated after being emitted from the metal tips 4 of the cathodes 2 excite the R, G, and B phosphor elements 12*a*, 12*b*, and 12*c*, to thereby generate luminescence.

However, there are the following problems in the conventional field emission display device. That is, the electrons emitted and accelerated from the metal tips 4 of the cathodes 2 not only advance straight forward to excite the corresponding phosphor element 12*b*, but also advance diverging to excite the adjacent phosphor elements 12*a* and 12*c*, thereby generating a crosstalk. Due to this phenomenon, the R, G, and B phosphor elements 12*a*, 12*b*, and 12*c* become simultaneously luminescent to generate a mixing of colors in the field emission display device, thereby deteriorating the screen quality of the device.

Moreover, since the R, G, and B phosphor elements 12*a*, 12*b*, and 12*c* are in a liquid state, it is difficult to pattern the R, G, and B phosphor elements 12*a*, 12*b*, and 12*c* in such a manner as to make them correspond to the cathodes 2.

Further, it is also difficult to form the spacer 14 after forming the phosphor elements 12*a*, 12*b*, and 12*c*, because the phosphor elements 12*a*, 12*b*, and 12*c* are not solid.

In addition, the laterally diverging electrons are charged in the spacers 14, so as to short-circuit the lower substrate 1 and the upper substrate 10, thereby generating a phenomenon of flashover.

SUMMARY OF THE INVENTION

Accordingly, the present invention has been made in an effort to solve the problems occurring in the related art, and it is an object of the present invention to provide a field emission display device, in which a phenomenon of crosstalk is prevented, thereby having an improved screen quality.

In accordance with one aspect, the present invention provides a field emission display device comprising:

an upper substrate and a lower substrate spaced apart with a predetermined gap and opposed to each other;

cathode assemblies formed in a shape of stripes on an inner surface of the lower substrate;

anodes formed on an inner surface of the upper substrate;

black matrices formed on the anodes, the black matrices being disposed at locations respectively corresponding to every space between the cathode assemblies, the black matrices respectively having a shape of a partition; and R, G, and B phosphor elements formed in spaces between the black matrices, the R, G, and B phosphor elements being disposed so as to respectively correspond to the cathode assemblies.

Preferably, the field emission display device may further comprise spacers for maintaining the gap between the upper substrate and the lower substrate, the spacers being respectively formed on inner surfaces of end black matrices which are disposed at both ends among an arrangement of the black matrices. The black matrices respectively have a height of a range between 20 and 300 micrometers.

More preferably, in the field emission display device, each of the cathode assemblies comprises:

a cathode formed in a shape of a stripe on the inner surface of the lower substrate;

a gate electrode formed above the cathode, the gate electrode having a plurality of holes formed through the gate electrode; and a plurality of metal tips formed on the cathode, the metal tips being exposed through the holes of the gate electrodes. The black matrices are any one of conductor material or insulator material.

In accordance with another aspect, the present invention provides a field emission display device comprising:

an upper substrate and a lower substrate spaced apart with a predetermined gap and opposed to each other;

cathode assemblies formed in a shape of stripes on an inner surface of the lower substrate;

anodes formed on an inner surface of the upper substrate;

black matrices formed from regions between the cathode assemblies on an inner surface of the lower substrate to regions between anodes on the inner surface of the upper substrate; and R, G, and B phosphor elements formed in spaces between the black matrices, the R, G, and B phosphor elements being disposed so as to respectively correspond to the cathode assemblies.

In this case also, each of the cathode assemblies may comprise:

a cathode formed in a shape of a stripe on the inner surface of the lower substrate;

a gate electrode formed above the cathode, the gate electrode having a plurality of holes formed through the gate electrode; and a plurality of metal tips formed on the cathode, the metal tips being exposed through the holes of the gate electrodes. However, the black matrices should be necessarily insulating.

In accordance with another aspect, the present invention provides a field emission display device comprising:

an upper substrate and a lower substrate spaced apart with a predetermined gap and opposed to each other;

cathode assemblies formed in a shape of stripes on an inner surface of the lower substrate;

black matrices formed on an inner surface of the upper substrate, the black matrices being disposed at locations respectively corresponding to every space between the cathode assemblies, the black matrices respectively having a shape of a partition;

anodes formed on the inner surface of the upper substrate, the anodes being respectively disposed between the black matrices; and R, G, and B phosphor elements formed on the anodes, the R, G, and B phosphor elements respectively corresponding to the cathode assemblies.

In this aspect also, the field emission display device may further comprise spacers for maintaining the gap between the upper substrate and the lower substrate, the spacers being respectively formed on inner surfaces of end black matrices which are disposed at both ends among an arrangement of the black matrices.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

The above and other objects, characteristics, and advantages of the present invention will be apparent from the following description along with the accompanying drawings.

Hereinafter, described in detail will be several preferred embodiments of the present invention, with reference to the accompanying drawings. In the following description and drawings, the like parts having the same function will be designated by the same numerals, and repetition of the same description will be avoided.

Figure 1:
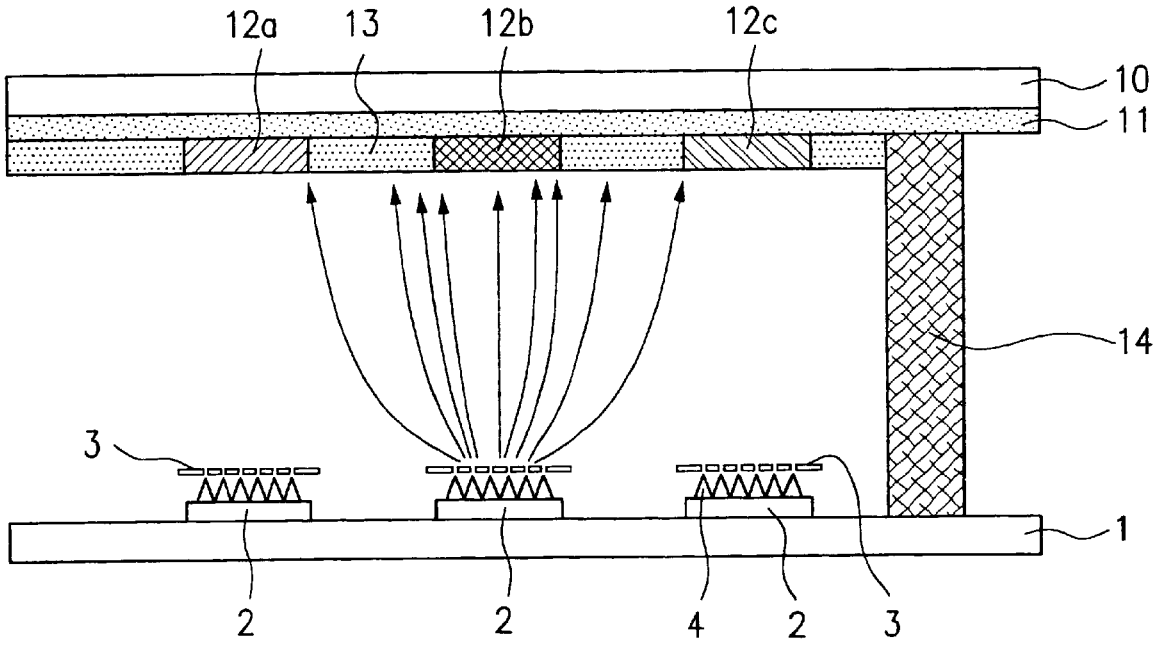
FIG. 1 (PRIOR ART)
FIG. 1 is a sectional view of a conventional field emission display device.
Figure 2:
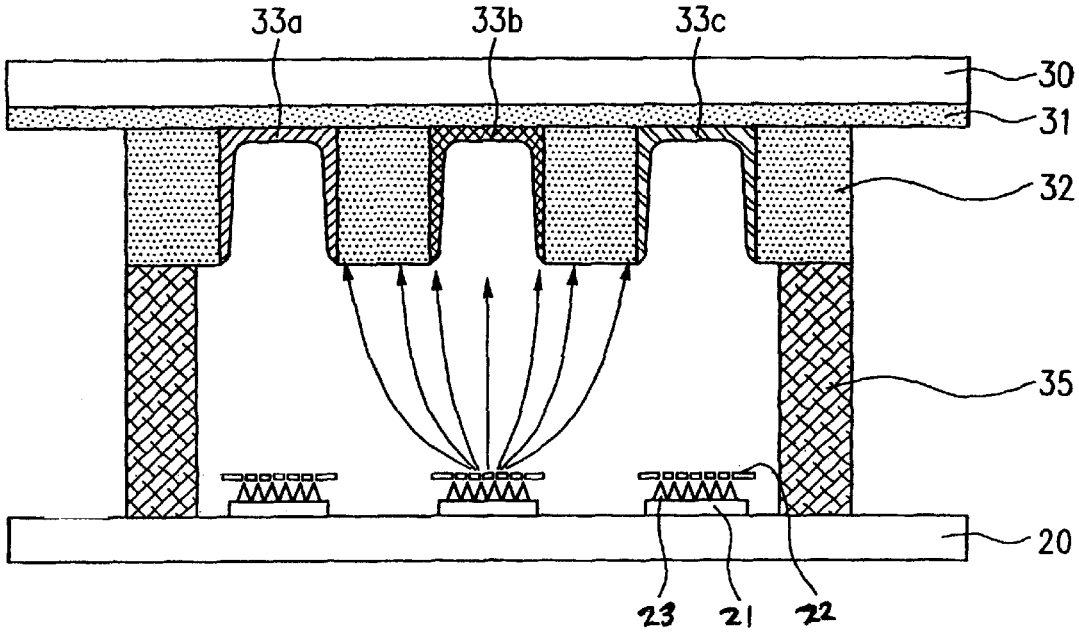
FIG. 2 is a sectional view of a field emission display device shown in FIG. 1.
Figure 3A:
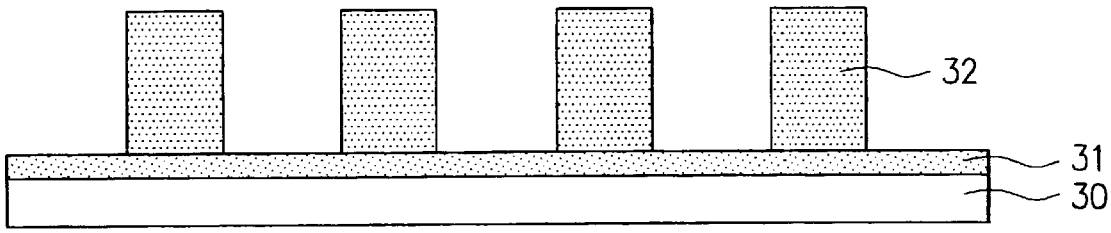
FIGS. 3A to 3C are sectional views for showing the process for manufacturing the field emission display device according to the first embodiment of the present invention.
Figure 3B:
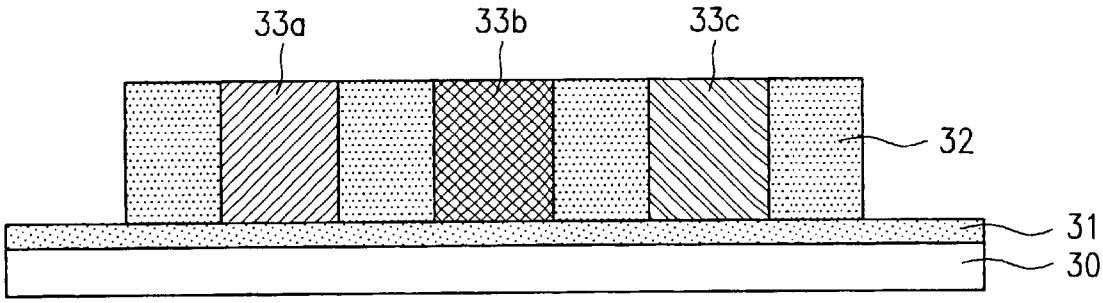
Figure 3C:
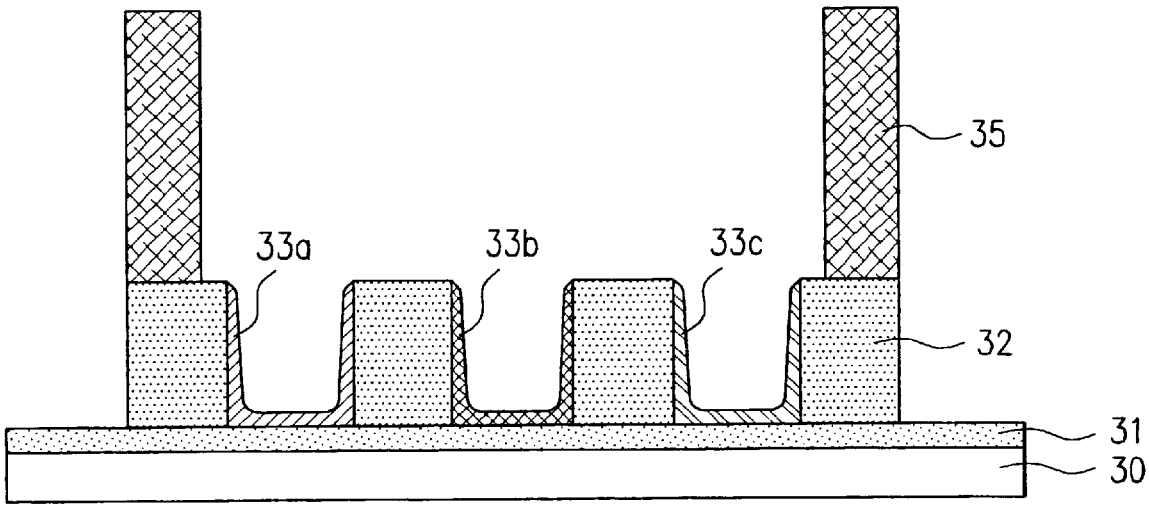
Figure 4:
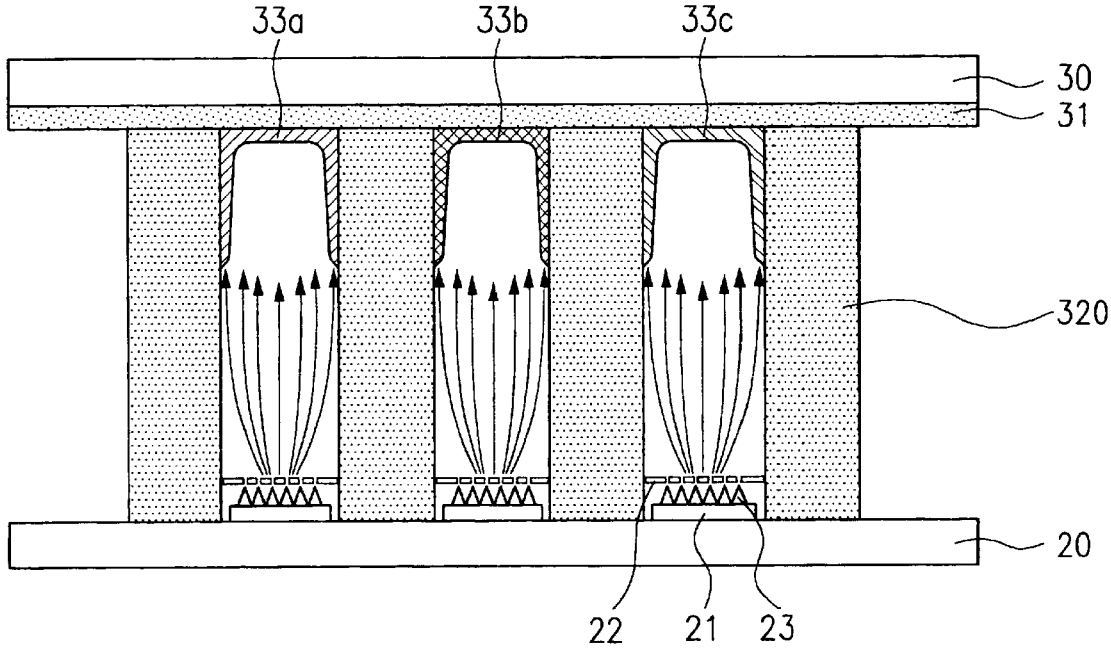
FIG. 4 is a sectional view of a field emission display device according to the second embodiment of the present invention.
Figure 5:
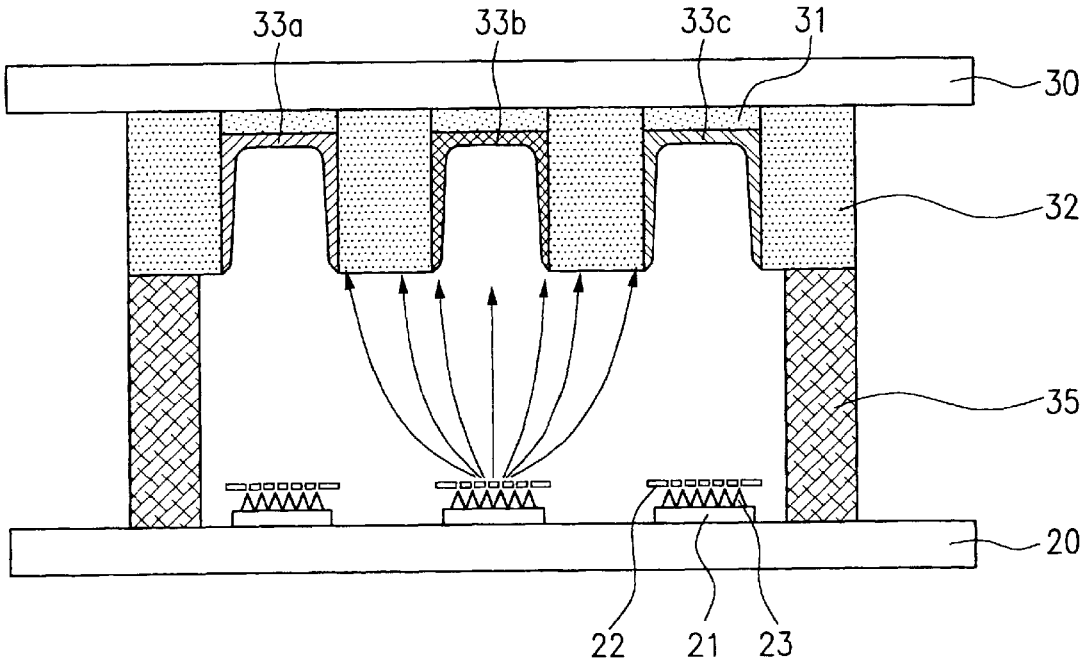
FIG. 5 is a sectional view of a field emission display device according to the third embodiment of the present invention.

FIGS. 2, 4, and 5 are sectional views of field emission display devices according to the first, the second, and the third embodiments of the present invention, and FIGS. 3A to 3C are sectional views for showing the process for manufacturing the field emission display device shown in FIG. 1.

Referring to FIG. 2, a lower substrate 20 and an upper substrate 30 are spaced with a predetermined gap from each other and opposed to each other. A plurality of cathodes 21 are formed in a shape of stripes on an inner surface of the lower substrate 20. Gate electrodes 22 are formed above the cathodes 21. Each of the gate electrodes 22 has a plurality of holes through which some portions of each cathode 21 are exposed. A plurality of metal tips 23 are formed on each of the cathodes 21, and are exposed through the holes of the gate electrodes 22. In this case, the metal tips 23 emit electrons when an electric field is applied between the cathodes 21 and the gate electrodes 22, as known in the art.

A plurality of anodes 31 are formed in a shape of stripes on an inner surface of an upper substrate 30 which is opposed to the lower substrate 20. The anodes 31 extend making angles with the extending direction of the cathodes 21, for example, the anodes 31 extend in the transverse direction of the cathodes 21 as shown. In this case, the anodes 31 are made from Indium-Tin Oxide (hereinafter, ITO) material. Black matrices 32 are formed in a shape of stripes on the anodes 31, in such a manner that the stripes of the black matrices 32 respectively correspond to the every space between the cathodes 21. In the present embodiment, the black matrices 32 are formed to have a height of a range between 20 and 300 micrometers, which is higher than that in the prior art, so that the black matrices 32 respectively have a shape of a partition. Since the black matrices 32 of the present invention are respectively formed like a partition having a relatively large height, the black matrices 32 block off the laterally diverging electrons, thereby preventing the adjacent phosphor elements 33*a* and 33*c* from becoming luminescent. R, G, and B phosphor elements 33*a*, 33*b*, and 33*c* are applied on inner surface of the black matrices 32 which respectively correspond to the cathodes 21. On the inner surfaces of the end black matrices 32, which are disposed at both ends among the arrangement of the black matrices 32, are respectively formed spacers 35 which respectively extend to the lower substrate 20.

Hereinafter, a method for manufacturing the upper substrate will be described, and the lower substrate is manufactured by a conventional method known in the art.

At first, as shown in FIG. 3A, an ITO film is deposited on the upper substrate 30, and then patterned so as to form the anodes 31. Thereafter, a film including black dye is formed with a thickness of about 20 to 300 micrometers on the anodes 31 by a screen printing method. In this case, the film including black dye may be conductive or insulating. Thereafter, a resist pattern is formed on the film including black dye by a conventional photolithography, and then the film including black dye is etched so that the black matrices 32 are formed. In this case, the black matrices 32, as described above, are formed in a shape of stripes respectively corresponding to the every space between the cathodes 21 of the lower substrate 20.

Thereafter, as shown in FIG. 3B, a paste of phosphor particles with a proper viscosity is filled in the spaces between the black matrices 32 by the screen printing method, so as to form the R, G, and B phosphor elements 33*a*, 33*b*, and 33*c*.

Thereafter, as shown in FIG. 3C, the R, G, and B phosphor elements 33*a*, 33*b*, and 33*c* are dried, so that moisture is removed from the liquid phosphor elements. Then, the R, G, and B phosphor elements 33*a*, 33*b*, and 33*c* are formed to cover the inner walls of the black matrices 32. Thereafter, the spacers 35 are formed according to a known method on the end black matrices 32 disposed at the both ends of the arrangement thereof. In this case, the R, G, and B phosphor elements 33*a*, 33*b*, and 33*c* do not require a separate patterning process, since they are formed by drying the liquid phosphor paste after filling it in the spaces between the black matrices 32. Further, it is easy to form the spacers 35, since the shapes of the R, G, and B phosphor elements 33*a*, 33*b*, and 33*c* are maintained constant.

As described above, according to the present embodiment, since the black matrices have an increased height in comparison with those of the prior art, they prevent the electrons from illuminating the phosphor elements adjacent to the corresponding phosphor element.

Hereinafter, a second embodiment of the present invention will be described with reference to FIG. 4.

In the present embodiment, the construction of the lower substrate 20, the anodes 31 of the upper substrate 30, and the R, G, and B phosphor elements 33*a*, 33*b*, and 33*c* are the same as those in the first embodiment, excepting the black matrices. Accordingly, omitted will be the description about the same elements as those in the first embodiment.

In the present embodiment, the black matrices 320 extend along the entire width of the gap between the lower substrate 20 and the upper substrate 30. That is, the black matrices 320 are formed to have a height of about 200 to 1000 micrometers in the case of a low-voltage field emission display device, while being formed to have a height of about two to five millimeters in the case of a high-voltage field emission display device. Accordingly, one end of each black matrix 320 reaches the anodes 31, while the other end of each black matrix 320 reaches the lower substrate 20. As described above, in the case where the black matrices 320 are formed to extend along the entire width of the gap between the lower substrate 20 and the upper substrate 30, separate spacers are not necessary. In this case, the black matrices 320 should be necessarily insulating, since they interconnect the lower substrate 20 and the upper substrate 30 with each other.

Meanwhile, the manufacturing method for the device according to the present embodiment is nearly the same as that according to the first embodiment, excepting that the R, G, and B phosphor elements 33*a*, 33*b*, and 33*c* are not filled in the entire spaces between the black matrices as in the first embodiment, but partially filled to a predetermined height in the spaces and then dried, when the R, G, and B phosphor elements 33*a*, 33*b*, and 33*c* are formed.

The black matrices formed along the entire width of the gap between the lower substrate 20 and the upper substrate 30 as described above completely block off the laterally diverging electrons, thereby preventing the phenomenon of crosstalk.

Hereinafter, a third embodiment of the present invention will be described with reference to FIG. 5.

In the present embodiment, the construction of the lower substrate 20, the black matrices 32 of the upper substrate 30, and the R, G, and B phosphor elements 33*a*, 33*b*, and 33*c* are the same as those in the first embodiment, excepting the construction of the anodes. Accordingly, omitted will be the description about the same elements as those in the first embodiment.

As shown in FIG. 5, the anodes 31 of the present embodiment are patterned in such a manner as to correspond to the cathodes 21. That is, the anodes 31 are disposed only beneath the R, G, and B phosphor elements 33*a*, 33*b*, and 33*c*. Such formation as described above can also achieve the same effect as that by the first and second embodiments.

Meanwhile, the manufacturing method for the device according to the present embodiment does not require an additional process, since the deposited ITO film is not patterned in a form of a plate, but patterned in such a manner as to correspond to the anodes 31.

In the field emission display device as described above in detail, the black matrices have an increased height in comparison with those in the prior art, thereby preventing the electrons from illuminating the phosphor elements adjacent to the corresponding phosphor element. Therefore, the R, G, and B phosphor elements are prevented from unintentionally simultaneously coming to be luminescent, thereby preventing the mixing of the colors and improving the screen quality.

Further, the phosphor elements are formed without the step of patterning the phosphor elements, since they are formed by drying a paste of phosphor particles after filling the paste in the spaces between the black matrices having a predetermined height.

Furthermore, it is easy to form the spacers, since the spacers are formed after the phosphor elements come to have their complete shapes.

While there have been illustrated and described what are considered to be preferred specific embodiments of the present invention, it will be understood by those skilled in the art that the present invention is not limited to the specific embodiments thereof, and various changes and modifications and equivalents may be substituted for elements thereof without departing from the true scope of the present invention.

What is claimed is:

1. A field emission display device comprising:

an upper substrate and a lower substrate, each of which has an inner surface facing the other inner surface in a substantially parallel manner;

cathode assemblies being formed on the inner surface of the lower substrate, wherein a space exists between two adjacent cathode assemblies;

anodes being formed on the inner surface of the upper substrate;

black matrices, each having sidewalls and each being formed on the anodes at a location correspondingly above the space between the cathode assemblies; and R, G, and B phosphor elements being formed only adjacent the anode in spaces between the black matrices and only adjacent the surfaces of the sidewalls of the black matrices near the anodes, wherein each phosphor element is correspondingly above one of the cathode assemblies formed on the inner surface of the lower substrate and further wherein the sidewalls adjacent the phosphor element prevent the electrons emitted from the non-corresponding cathode assemblies from illuminating the phosphor element.

2. A field emission display device as claimed in claim 1, further comprising spacers for maintaining the gap between the upper substrate and the lower substrate, the spacers being respectively formed on inner surfaces of end black matrices which are disposed at both ends among an arrangement of the black matrices.

3. A field emission display device as claimed in claim 1, wherein the black matrices respectively have a height of a range between 20 and 300 micrometers.

4. A field emission display device as claimed in claim 1, wherein each of the cathode assemblies comprises:

a cathode formed in a shape of a stripe on the inner surface of the lower substrate;

a gate electrode formed above the cathode, the gate electrode having a plurality of holes formed through the gate electrode; and a plurality of metal tips formed on the cathode, the metal tips being exposed through the holes of the gate electrodes.

5. A field emission display device as claimed in claim 1, wherein the black matrices are any one of conductor material or insulator material.

6. A field emission display device comprising:

an upper substrate and a lower substrate, each of which has an inner surface facing the other inner surface in a substantially parallel manner;

cathode assemblies being formed on the inner surface of the lower substrate, wherein a space exists between two adjacent cathode assemblies;

anodes being formed on the inner surface of the upper substrate;

black matrices extending between the anodes and the inner surface of the lower substrate and having a space between two black matrices, wherein each of the cathode assemblies is positioned on the inner surface of the lower substrate in the space between two black matrices; and R, G and B phosphor elements being formed on the anodes in spaces between the black matrices and on the sidewalls of the black matrices near the anodes, the R, G, and B phosphor elements being disposed so as to respectively correspond to the cathode assemblies, wherein one pair of one phosphor element and the corresponding cathode assembly are separated from another pair of one phosphor element and the corresponding cathode assembly by one black matrix that extends between the anode and the inner surface of the lower substrate.

7. A field emission display device as claimed in claim 6, wherein each of the cathode assemblies comprises:

a cathode formed in a shape of a stripe on the inner surface of the lower substrate;

a gate electrode formed above the cathode, the gate electrode having a plurality of holes formed through the gate electrode; and a plurality of metal tips formed on the cathode, the metal tips being exposed through the holes of the gate electrodes.

8. A field emission display device as claimed in claim 6, wherein the black matrices are insulating.

9. A field emission display device comprising:

an upper substrate and a lower substrate, each of which has an inner surface facing the other inner surface in a substantially parallel manner;

cathode assemblies being formed on the inner surface of the lower substrate, wherein a space exists between two adjacent cathode assemblies;

black matrices, each having sidewalls and each being formed on the inner surface of the upper substrate at a location on the upper substrate inner surface correspondingly above the space between two adjacent cathode assemblies;

anodes, each of which is being formed on a portion of the inner surface of the upper substrate between two adjacent black matrices; and R, G, and B phosphor elements formed on the anodes and on the sidewalls of the black matrices near the anodes without a layer therebetween, wherein each phosphor element is coated on the surface of the anode and on the surfaces of the sidewalls to create the surface area of each phosphor element on the surface of the anode and on the surfaces of the sidewalls and wherein each phosphor element is correspondingly above one of the cathode assemblies formed on the inner surface of the lower substrate and further wherein the sidewalls adjacent the phosphor element prevent the electrons emitted from the non-corresponding cathode assemblies from illuminating the phosphor element.

10. A field emission display device as claimed in claim 9, further comprising spacers for maintaining the gap between the upper substrate and the lower substrate, the spacers being respectively formed on inner surfaces of end black matrices which are disposed at both ends among an arrangement of the black matrices.

11. A field emission display device comprising:

a lower substrate having a lower substrate inner surface;

an upper substrate having an upper substrate inner surface facing the lower substrate inner surface in a substantially parallel manner;

an anodes being formed on the upper substrate inner surface;

a cathode assembly being formed on a portion of the lower substrate inner surface;

two black matrices having sidewalls being formed on the anodes with a space between the two black matrices, wherein the space between the two black matrices is positioned correspondingly above the cathode ray assembly formed on the lower substrate inner surface; and a phosphor element being formed on a portion of the sidewalls of the black matrices near the anodes, wherein a phosphor material of R, G, or B phosphor element is thinly coated substantially on the surfaces of the sidewalls without a layer therebetween.

12. The field emission display device of claim 11, wherein the anode is made from Indium-Tin Oxide material.

* * * * *